US005506663A

United States Patent [19]

Ulrich et al.

[11] Patent Number: 5,506,663

[45] Date of Patent: Apr. 9, 1996

[54] SCANNER MOUNTING APPARATUS FOR AN ELECTROSTATOGRAPHIC PRINTING MACHINE

[75] Inventors: Vernon W. Ulrich, Fairport; Randall E. Van Ryne, Rochester, both of N.Y.

[73] Assignee: Xerox Corporation, Stamford, Conn.

[21] Appl. No.: 334,995

[22] Filed: Nov. 7, 1994

[51] Int. Cl.[6] ..... G03G 15/28

[52] U.S. Cl. ..... 355/235; 355/233

[58] Field of Search ..... 355/69, 210, 232, 355/233, 228, 229, 235, 308

[56] References Cited

U.S. PATENT DOCUMENTS

| | | | |
|---|---|---|---|
| 3,752,558 | 8/1973 | Lloyd | 355/235 |
| 4,110,803 | 8/1978 | Townsend | 360/109 |
| 4,248,528 | 2/1981 | Sahay . | |
| 4,757,348 | 7/1988 | Rourke et al. . | |
| 4,929,983 | 5/1990 | Barton et al. | 355/308 X |
| 4,980,719 | 12/1990 | Allen et al. | 355/201 |
| 5,101,287 | 3/1992 | Akuzawa | 355/235 X |
| 5,280,368 | 1/1994 | Fullerton | 355/235 X |

FOREIGN PATENT DOCUMENTS 2159648 12/1985 United Kingdom .

2240646 8/1991 United Kingdom .

*Primary Examiner*—Sandra L. Brase

*Attorney, Agent, or Firm*—Denis A. Robitaille

[57] ABSTRACT

An apparatus for mounting a scanner along a paper path in an electrostatographic printing machine for permitting scanning of an information bearing code from a copy sheet traveling in a process direction of travel through the paper path. The scanner mounting apparatus includes a a slidable support platform, for permitting slidable movement of the scanner in a direction transverse to the process direction of travel of a copy sheet, the slidable support platform further having a rotatable housing mounted thereto for permitting rotational movement of the optical scanner in a plane parallel to the copy sheet. The freedom of movement provided by the combination of the slidable support platform and the rotatable housing cooperate to provide a mounting which permits selective positioning of the scanner for proper alignment with the information bearing bar code independent of its location on the copy sheet, while further permitting selective orientation of the scanner for proper orientation with the information bearing bar code independent of its orientation on the copy sheet.

20 Claims, 4 Drawing Sheets

SCANNER MOUNTING APPARATUS FOR AN ELECTROSTATOGRAPHIC PRINTING MACHINE

The present invention relates generally to an electrostatographic printing machine, and more specifically concerns a mounting apparatus for selective position and orientation of a scanning device in an electrophotographic printing machine.

In a typical electrostatographic printing process, a photoconductive member is charged to a substantially uniform potential so as to sensitize the surface thereof. The charged portion of the photoconductive member is exposed to a light image of a document being produced. Exposure of the charged photoconductive member selectively dissipates the charge thereon in the irradiated areas. This process records an electrostatic latent image on the photoconductive member corresponding to the informational areas contained within the document being produced. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy substrate such as a sheet of paper. Thereafter, heat or some other treatment is applied to the toner particles to permanently affix the powder image to the copy substrate. In a final step in the process, the photoreceptive member is cleaned to remove any residual developing material on the photoconductive surface thereof in preparation for successive imaging cycles.

The electrostatographic printing process described above is well known and is commonly used for printing documents of various types. Analogous processes also exist in other electrostatographic printing applications such as, for example, ionographic printing and reproduction, where charge is deposited on a charge retentive surface in response to electronically generated or stored images.

High speed electrostatographic printing machines of the type described hereinabove have been successfully employed for printing important negotiable documents such as bank checks, stocks, bonds and other negotiable instruments as well as other important documents such as invoice statements, highway tickets and identification badges. Generally, a portion of the developed image on documents of this nature are provided with magnetic ink characters, such as E-13B font characters recognized as unique characters of a specified type which can subsequently be advantageously processed in reader/sorter devices. Exemplary products which are capable of producing so-called magnetic ink character recognition (MICR) documents include the Xerox Corporation model 9790 and model 4635 MX printing machines.

In the particular type of printing application described above, it is very important that the integrity and security of the printed documents be maintained at all times. MICR printing applications often require the tracking of each individual document as it passes through the printer to provide some accounting of the number of documents printed as well as feedback regarding the information printed onto each document which, in turn, provides, some assurance of job integrity. To this end, output copy sheets or other media on which a negotiable instrument or other important document is printed often includes an information bearing indicia such as a well known bar code. The bar code includes some encoded information which may be printed on the output copy sheets by the printer, or may be preprinted on sheets placed in the input tray of the printer. The bar coded sheets are scanned upon output from the printer by means of a known optical scanner or reader such as an LED based bar code reader, positioned in the path of the output sheets, typically between the print engine and the final paper handling or finishing device. The printer may also include other optical scanners positioned at other points in the paper path. In this manner, any misprints or duplicates can be detected before the final paper handling stage and, more importantly, specific information regarding the data printed onto each document can be monitored and communicated to the machine operator or customer in order to provide an audit for print job integrity and security purposes.

Thus, it is well known to provide an electrostatographic printing apparatus with an optical scanning device for monitoring print machine output documents. In addition to the applications cited hereinabove, optical scanners and other scanning devices have also been incorporated into copier machines for scanning preprinted and/or operator marked input control sheets, wherein various machine control modes and job control information can be input via the control sheet such that copies can be produced without requiring manual operator input via a control panel.

Generally, incorporation of scanning devices in electrostatographic printing and copying machines has required that the information bearing code to be scanned is positioned at a precise predetermined location and orientation on the document, as determined by the specific location and orientation of the bar code scanner in the electrostatographic machine. However, with the advent of numerous and varied applications which might take advantage of the many advantages of MICR processing as well as other applications which may exploit optical and other scanning technology, it is desirable to provide an electrostatographic printing machine with a selectively positionable and orientatable scanner mounting apparatus so that a bar code or other information bearing code can be printed on a document and/or scanned therefrom at various locations and orientations. For example, it would be advantageous to provide a bar code scanner mounting capable of reading bar codes printed in either a portrait or a landscape mode, wherein portrait mode printing is defined as an image that is read with the short edge of the page representing the horizontal axis of the output sheet while landscape mode printing is defined as an image that is read with the short edge of the page representing the vertical axis of the output sheet.

Various techniques are known for enabling scanning or bar code reading in an electrostatographic printing apparatus. The prior art, however, does not disclose an electrostatographic printing machine wherein an optical scanner can be selectively positioned and/or oriented relative to the information bearing code being scanned such that the position and orientation of the code on the document need not be limited to the position and orientation of the optical scanner in the electrostatic machine.

The following disclosures may be relevant to various aspects of the present invention:

U.S. Pat. No 4,248,528

Patentee: Sahay

Issued: Feb. 3, 1981

U.S. Pat. No 4,757,348

Patentee: Rourke et al.

Issued: Jul. 12, 1988

U.S. Pat. No 4,980,719

Patentee: Allen et al.

Issued: Dec. 25, 1990

The relevant portions of the foregoing disclosures may be briefly summarized as follows:

U.S. Pat. No. 4,248,528 discloses a copier control system in which preprinted and operator marked control sheets otherwise corresponding to the regular original document sheets being copied are fed together with those regular documents by the copier document feeder past an optical scanner connected to the copier controller. The document sheets are copied in the manner instructed by the preceding control sheets, without requiring manual switch inputs, while the copying of the control sheet itself is automatically inhibited.

U.S. Pat. No. 4,757,348 discloses an electronic reprographics/printing machine including at least one scanning array for converting images on documents to image signals, a document tray for holding a stack of the documents to be scanned, a document transport to bring the documents from the tray to the array for scanning, a controller, an input device for programming in programming parameters with an associated separator code, a control sheet with a bar code representation of the same separator code for interleving with the documents for scanning by the array, a bar code discriminator for distinguishing documents with bar codes from documents without bar codes, a bar code reader for reading the bar code to identify the separator code thereon, and a control to match the separator code obtained from the control sheet with the separator code associated with the programming parameters, whereby the controller operates the machine in accordance with the program parameters.

U.S. Pat. No. 4,980,719 discloses a reproduction method and apparatus providing secure reproduction of confidential documents that include image portions formed with magnetic or metallic toners. The method and apparatus of that patent also provides for the production of documents such as statements with checks having bank clearing data formed with magnetic toner, documents containing magnetically bar coded date, and documents recorded with with either or both magnetic or non-magnetic toner that may be distinguished when copied in accordance with a copying criterion established for reproducing secure documents.

It is desirable to provide an electrostatographic printing machine with a scanning device that can be selectively positioned and oriented such that the scanning device can read an information bearing code on a document as it is output from the print section of the electrostatographic printer without any limitation as to the location and/or orientation of the information bearing code on the output document. It is further desirable to provide the aforementioned electrostatographic printing machine having the selectively positionable and orientatable scanning device with the capability to communicate the information from the information bearing code to an electronic subsystem (ESS) such that the information can be displayed to the operator or otherwise assimilated into a summary or report which may be provided to the operator and/or the print job customer.

In accordance with the present invention, there is provided an apparatus for mounting a scanner along a paper path for permitting scanning of an information bearing code from a document traveling in a process direction of travel through the paper path. The mounting apparatus comprises means for selectively positioning the scanner in a direction transverse to the process direction of travel to position the scanner in substantial alignment with the information bearing code on the document traveling through the paper path, as well as means for selectively rotating the scanner with respect to the document travelling through the paper path to position the scanner in proper orientation for reading the information bearing code on the document traveling through the paper path.

Pursuant to another aspect of the present invention, there is provided an electrophotographic printing machine including a scanner for scanning an information bearing code situated on a document. The electrophotographic printing machine comprises an apparatus for mounting the scanner along a paper path, wherein the document travels in a process direction of travel through the paper path and the mounting apparatus includes means for selectively positioning the scanner in a direction transverse to the process direction of travel to position the scanner in substantial alignment with the information bearing code on the document traveling through the paper path, as well as means for selectively rotating the scanner with respect to the document travelling through the paper path to position the scanner in proper orientation for reading the information bearing code on the document traveling through the paper path.

Other aspects of the present invention will become apparent as the following description proceeds and upon reference to the drawings, in which.

Figure 1:
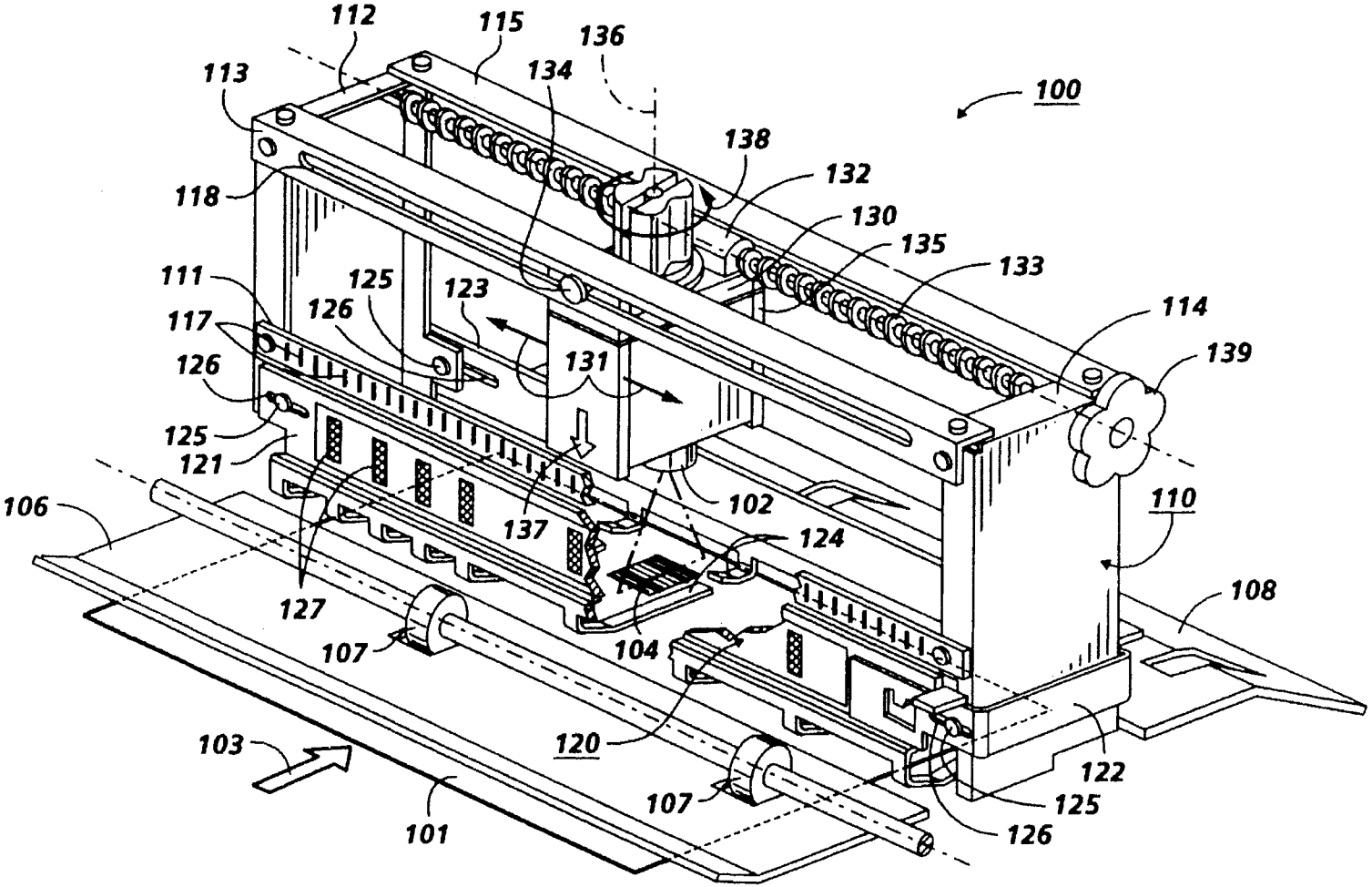
FIG. 1 is a perspective view of an illustrative mounting apparatus for selectively positioning and orienting an optical scanner in an electrostatographic printing machine.

While the present invention will hereinafter be described in connection with a preferred embodiment and process, it will be understood that this description is not intended to limit the invention to the particular embodiment or process. On the contrary, the following description is intended to cover all alternatives, modifications, and equivalents, as may be included within the spirit and scope of the invention as defined by the appended claims. Other aspects and features of the present invention will become apparent as the following description progresses.

For a general understanding of the features of the present invention, reference is made to the drawings, wherein like reference numerals have been used to identify particular elements, components and subsystems. Inasmuch as the art of electrostatographic printing is well known, the various processing stations employed in such reproduction machines will initially be described briefly with reference to FIG. 4. It will become apparent from the following discussion that the scanner mounting apparatus of the present invention is equally well suited for use in a wide variety of electrophotographic or other electronic printing systems. It will be further understood that the present invention is not necessarily limited in its application to the particular embodiment or embodiments shown and described herein.

Figure 4:
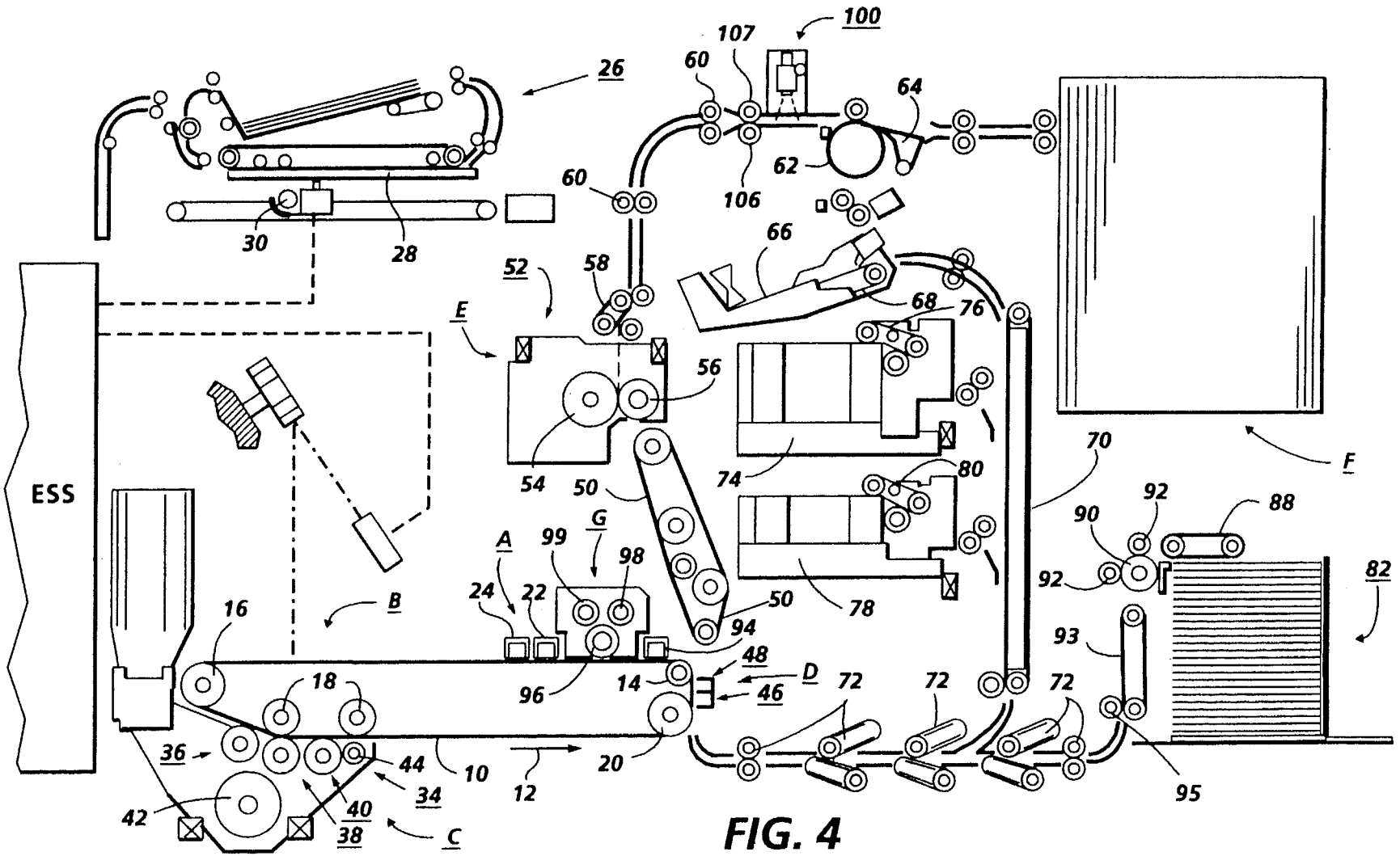
FIG. 4 is a schematic elevational view depicting an illustrative electrostatographic printing machine of the type which could advantageously utilize the scanner mounting apparatus of the present invention.

Turning initially to FIG. 4, prior to discussing the invention in detail, a schematic depiction of an exemplary electrostatographic printing machine incorporating various subsystems is furnished wherein a photoconductive belt 10 is employed, preferably comprising a photoconductive material coated on a ground layer, which, in turn, is coated on an anti-curl substrate. The photoconductive material typically includes a transport layer, which may contain molecules of di-m-tolydiphenylbiphenyldiamine dispersed in a polycarbonate, coated on a generator layer, generally made from trigonal selenium. The grounding layer is typically made from a titanium coated Mylar. Of course, other suitable photoconductive materials, ground layers, and anti-curl substrates may also be employed.

Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under a desired tension. Drive roller 20 is rotated by a motor (not shown) coupled thereto by any suitable means such as a drive belt. Thus, the rotational movement of roller 20 advances belt 10 in the direction of arrow 12 to advance successive portions of the photoconductive surface sequentially through the various processing stations disposed about the path of movement thereof.

Initially, a portion of photoconductive belt 10 passes through charging station A whereat two corona generating devices, indicated generally by reference numerals 22 and 24, charge photoconductive belt 10 to a relatively high, substantially uniform potential. This dual or "split" charging system is designed so that corona generating device 22 places all of the required charge on photoconductive belt 10 while corona generating device 24 acts as a leveling device to provide a uniform charge across the surface of the belt. Corona generating device 24 also fills in any areas which may have been missed by corona generating device 22.

Next, the charged portion of photoconductive belt 10 is advanced through imaging station B, whereat the uniformly charged photoconductive belt 10 is selectively discharged by a raster output scanner 30 creating a latent image of information that is to be printed. The raster output scanner generally includes a laser, a polygon surface, lenses, and mirrors. The laser generates a laser beam which places information on photoconductive surface of belt 10 by switching the laser on and off as it rotates, or scans across the width of the belt. The rotating polygon surface sweeps the laser beam across the belt causing the information to be printed in a pattern of on/off dots. The lenses ensure that the beam shape is circular and that the beam scan is straight across the belt. The mirrors ensure that the optical system can fit into a small space. This imaging process records an electrostatic latent image on photoconductive belt 10 corresponding to the informational areas contained within the original document. Thereafter, photoconductive belt 10 advances the electrostatic latent image recorded thereon to development station C.

It is noted that imaging station B may be coupled to a magnetic tape reader system (not shown) which provides digital information directly to the raster output scanner 30 via an electronic subsystem (ESS) which will be described in greater detail hereinbelow for creating a latent image of information that is to be printed. In addition, the imaging station B, and, in particular, the raster output scanner 30 may also include a bar code printer (not shown) which is capable of producing a bar code image in response to digital information from the magnetic tape reader system. The described magnetic tape reader/bar code printer system is one of various methods of producing financial documents or negotiable instruments with an encoded information bearing data code for providing a job integrity system as contemplated for use with the scanner mounting apparatus of the present invention.

At development station C, a magnetic brush developer housing, indicated generally by the reference numeral 34, is provided, having three developer rolls, indicated generally by the reference numerals 36, 38 and 40. A paddle wheel 42 picks up developer material, generally comprising triboelectrically charged carrier granules and toner particles, in the developer housing 34 for delivering the developer material to the developer rolls. When the developer material reaches rolls 36 and 38, it is magnetically split between the rolls with approximately half of the developer material being delivered to each roll. Photoconductive belt 10 is situated adjacent rolls 36 and 38 for attracting toner particles from an extended development zone formed thereby. Developer roll 40 is a cleanup roll and magnetic roll 44 is a carrier granule removal device adapted to remove any carrier granules adhering to belt 10. Thus, rolls 36 and 38 advance developer material into contact with the electrostatic latent image, whereby the latent image attracts toner particles from the carrier granules of the developer material to form a toner powder image on the photoconductive surface of belt 10.

After development, belt 10 then advances the toner powder image to transfer station D, where a sheet of support material or copy sheet (not shown) is moved into contact with the toner powder image. As can be seen in the illustrated embodiment, a corona generating device 46 charges the copy sheet to a proper potential so that the sheet is electrostatically secured or "tacked" to belt 10. Corona generating device 46 also provides electrostatic fields for attracting the toner image from the photoreceptor belt 10 to the copy sheet. Thus, the transfer station operates to induce contact between the developed image on belt 10 and the sheet of support material for transfer of the toner image thereon.

A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D.

Copy sheets may also be fed to transfer station D from a secondary tray 74 or an auxiliary tray 78 for providing additional sheet capacity or special types of copy sheets. Each tray includes an elevator driven by a bidirectional AC motor and a controller having the ability to drive the tray up or down. When the tray is in the down position, stacks of copy sheets are loaded thereon or unloaded therefrom. In the up position, successive copy sheets may be dispersed therefrom by a sheet feeder 76. Sheet feeder 76 may comprise a friction retard feeder utilizing a feed belt and take-away rolls to advance successive copy sheets to transport 70 which, in turn, advances the sheets to rolls 72 and then to transfer station D. It will be recognized that secondary tray 74 and auxiliary tray 78 are supplemental sources of copy sheets for providing machine adaptability and flexibility for particular print jobs.

After the developed image is transferred to the copy sheet, a second corona generator 48 charges the copy sheet to a polarity opposite that provided by corona generator 46 for electrostatically separating or "detacking" the copy sheet from belt 10. Thereafter, the inherent beam strength of the copy sheet causes the sheet to separate from belt 10 onto conveyor 50, positioned to receive the copy sheet for transporting the copy sheet to fusing station E.

Fusing station E includes a fuser assembly, indicated generally by the reference numeral 52, for permanently affixing the transferred toner powder image to the copy sheet. Preferably, fuser assembly 52 includes a heated fuser roller 54 and a pressure roller 56. The developed copy sheet is transported to the fusing station with the powder image on the copy sheet contacting fuser roller 54. The pressure roller 56 abuts the fuser roller 54 to provide the necessary pressure to fix the toner powder image to the copy sheet. In this exemplary fuser assembly, the fuser roll 54 is internally heated by a quartz lamp while a release agent, stored in a reservoir, is pumped to a metering roll which eventually applies the release agent to the fuser roll.

After fusing, the copy sheets are fed through a decurling apparatus 58 which bends the copy sheet in one direction to put a known curl in the copy sheet, thereafter bending the copy sheet in the opposite direction to remove that curl as well as any other curls or wrinkles which may have been introduced into the copy sheet. The copy sheet is then advanced, via forwarding roller pairs 60 to duplex turn roll 62 and onward to duplex solenoid activated gate 64 which selectively guides the copy sheet to a finishing station, identified by reference letter F, or to duplex tray 66. Thus, the solenoid activated gate 64 can be used to divert output copy sheets into duplex tray for, providing intermediate storage for those sheets that have been printed on one side and on which an image will be subsequently printed on the second, opposed side thereof, i.e. the sheets being duplexed. Duplex sheets are typically stacked in duplex tray 66 face down in a configuration, one on top of another, in the order in which they are copied. In order to complete duplex copying, the simplex sheets in tray 66 are fed, in seriatim, by a bottom feeder 68, from tray 66 back to transfer station D, via conveyor 70 and rollers 72. These sheets are then transported back to the transfer station for transfer of a toner powder image to the opposite sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet so as to be advanced to finishing station F.

Invariably, after the copy sheet is separated from photoconductive belt 10, some residual particles remain bonded thereto. Thus, after transfer, photoconductive belt 10 passes beneath yet another corona generating device 94 which charges the residual toner particles to the proper polarity for breaking the bond between the toner particles and the belt. Thereafter, a precharge erase lamp (not shown), located inside the loop formed by photoconductive belt 10, discharges the photoconductive belt in preparation for the next charging cycle. Residual particles are removed from the photoconductive surface at cleaning station G which may include an electrically biased cleaner brush 96 and two waste and reclaim de-toning rolls 98 and 100, as illustrated. The reclaim roll 98 may be electrically biased to a polarity opposite that of the cleaner roll 96 so as to remove toner particles therefrom while the waste roll 99 may also be electrically biased positively relative to the reclaim roll 98 so as to remove paper debris and wrong sign toner particles. The toner particles on the reclaim roll 98 are scraped off and deposited in a reclaim auger (not shown), where they are transported out of the rear of cleaning station G.

It is noted that an electrostatographic printing machine contemplated for use with the present invention may also include a system for applying magnetic ink character recognition (MICR) media for providing documents having variable or fixed magnetic data imprinted thereon in MICR format which may subsequently be read by a MICR reader for processing thereof. The utilization of magnetically encoded information on documents reproduced with magnetic particles is well known and various apparatus and methods for the application of MICR media to xerographic images are disclosed, as for example, in U.S. Pat. No. 5,083,157 and the patents cited therein. The relevant teachings of that patent are incorporated by reference herein.

The electrostatographic printing machine contemplated for use in combination with the present invention will also include a scanner device, such as an optical bar code scanner of the type well known in the art, for scanning and reading the output document after it has been imaged in the xerographic engine. An exemplary optical scanning system 100 is illustrated at the input to duplex gate 64 so as to permit the scanning of duplex documents. It is contemplated that the scanner will be provided with appropriate construction and connecting circuitry such that various suitable information bearing patterns can be utilized for the appropriate encoding. One exemplary optical bar code scanning device which has been found to be satisfactory for use in the presently described embodiment is a device manufactured by Accusort Systems Inc., namely the Model 20 Bar Code Scanner, however, various other optical scanning devices provided by numerous manufacturers have been shown to provide satisfactory results.

The various machine functions of the above described electrostatographic printer are regulated by an electronic subsystem (ESS) which preferably includes a programmable microprocessor for managing all of the machine functions hereinbefore described. The printer ESS controls all the printer steps and functions as described herein, including imaging onto the photoreceptor, paper delivery, xerographic functions associated with developing and transferring the developed image onto the paper, and various processing functions provided by finishing station F. The printer ESS also initiates a sequencing schedule which is highly efficient in monitoring the status of a series of successive print jobs which are to be printed and finished in a consecutive fashion. In addition, conventional sheet path sensors or switches, which may be utilized to keep track of the position of documents and the sheets in the machine will be coupled to the ESS for regulating the various positions of gates and switching mechanisms, depending upon the mode of operation selected. The ESS may also provide time delays, jam indications and fault actuation. Most importantly, with respect to the present invention, the ESS may be coupled to the optical scanner 100 for providing the capability to communicate the information read from the information bearing to the ESS so that specific information regarding the data printed onto each document can be monitored, displayed or otherwise assimilated into a summary or report which may be provided to the operator and/or the print job customer in order to provide a print job audit to insure print job integrity and security. The operation of all of the exemplary systems described hereinabove may be accompanied by a conventional user interface control device having the capability to provide operator input and output information through a console or graphic user interface device.

The foregoing description should be sufficient for the purposes of the present disclosure for patent to illustrate the general operation of an electrophotographic reproducing apparatus incorporating the features of the present invention. As previously discussed, the electrophotographic reproducing apparatus may take the form of any of several well known devices or systems such that variations of specific electrostatographic processing subsystems or processes may be expected without affecting the operation of the present invention.

Figure 2:
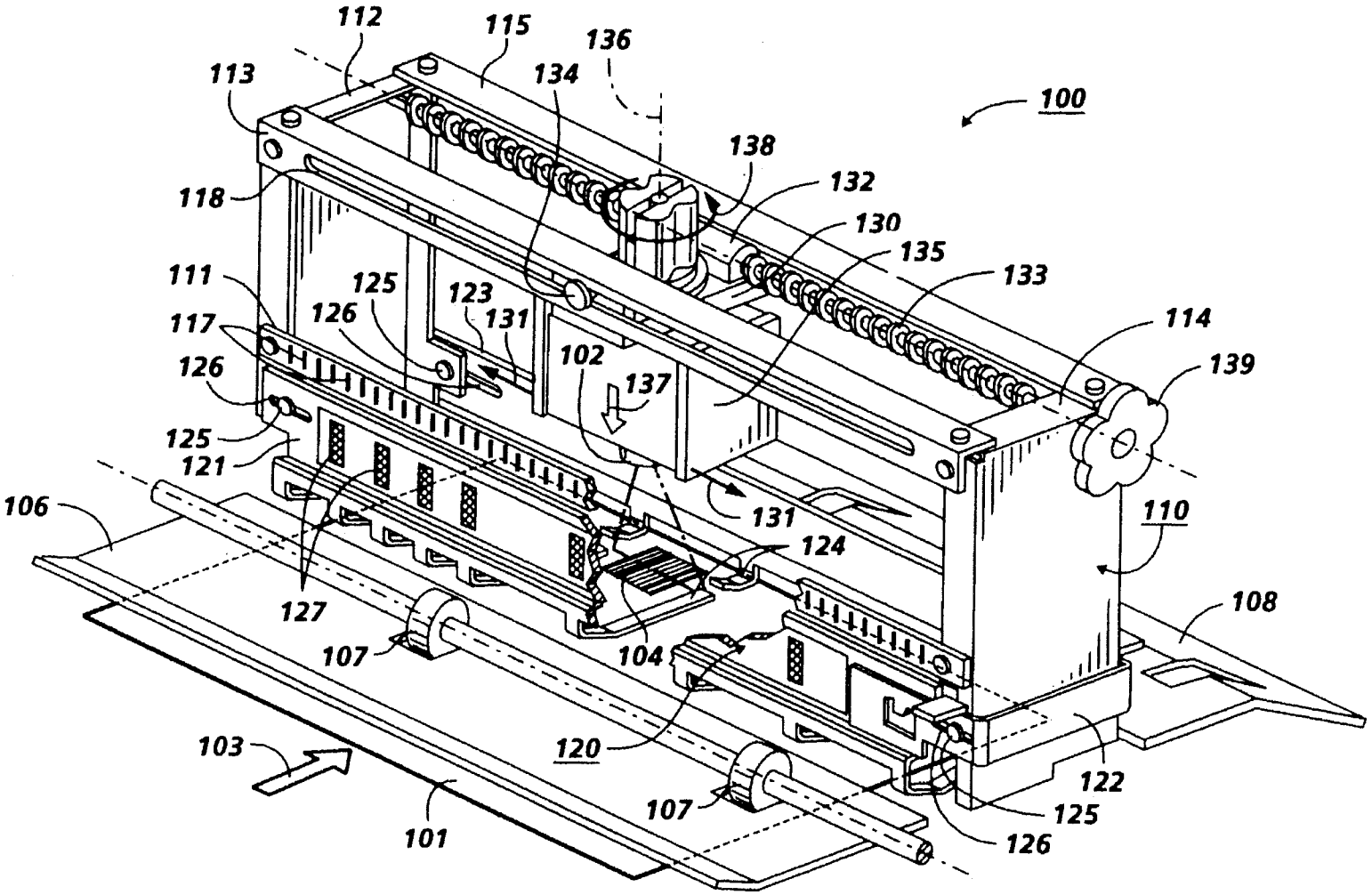
FIG. 2 is a perspective view of the illustrative mounting apparatus of FIG. 1, showing the optical scanner rotated 90 degrees for scanning an information bearing bar code oriented perpendicular to the process direction of the output copy sheet.

Referring now to FIGS. 1 and 2, the particular features of the scanner mounting apparatus 100 of the present invention operating in combination with the above-described electrostatographic printing machine will be described in greater detail. The scanner mounting apparatus 100 is preferably located in the paper path which leads printed output documents out of the printing portion of the machine toward the finisher section F so that a scanning device 102 can scan or read the printed information bearing code or so-called bar code 104 printed on the output copy sheet 101 as the sheet 101 exits the electrostatographic printing section of the machine with the bar code 104 and any corresponding image fused thereto. In this manner, the copy sheet 101 is transported passed the scanner 102, in a process direction (indicated by arrow 103) along a paper path defined by upstream sheet baffle member 106 and downstream sheet baffle member 108 via a sheet transport system including transport rollers 107. It will be appreciated that the sheet transport system described herein includes various other components including additional transport rollers and baffle members (as shown schematically in FIG. 4) which have been eliminated from the drawings of FIGS. 1 and 2 in order to provide clarity and simplicity to the drawings.

It will be understood that various scanning devices such as optical scanning devices, magnetic scanners and the like are contemplated for use with the present invention. In a preferred embodiment, scanning device 102 is an optical scanner of the type well known in the art which typically includes an LED emitter for creating a light beam (represented by a triangular shape exiting the optical scanner), and a light sensitive receiver for detecting a portion of the light beam beam reflected off of the copy sheet 101. It is noted that it is preferable that an optical scanner be situated at a slight angle relative to the scan line of the bar code so as to avoid collecting significant portions of return beams that occur in the absence of an output copy sheet 101, thereby preventing the detection of spurious light beams and other signals which may be otherwise misinterpreted as bar codes or other information. Thus, the optical scanner 102 is preferably positioned at a slight angle (approximately 6 degrees) relative to the scan line on the copy sheet such that the beam does not strike the copy sheet 101 an angle perpendicular thereto while maintaining the capability to detect a significant amount of the reflected light beam.

Figure 3:
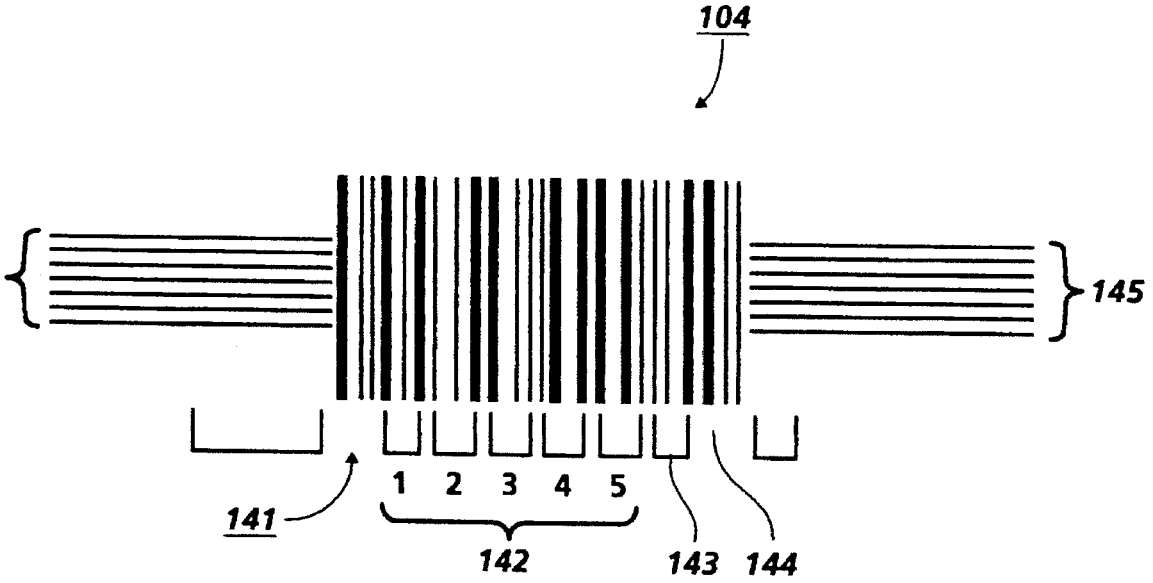
FIG. 3 is an illustration of a typical bar code.

An exemplary bar code 104 which may be effectively used in combination with the present invention for providing digital input data to scanner 102, corresponding to the information printed on the output copy sheet 101 is shown in FIG. 3. It is contemplated that the exemplary bar code will provide a digital representation of the information printed on the output document, such as, for example, the cash amount of a particular negotiable instrument printed in the electrostatographic machine. This data is scanned, recorded and processed (preferably via the ESS, coupled thereto) in any manner requested by the customer in order to provide particular tracking information, as desired. For example, a customer may require that the amount of each check be scanned and summed to a total amount for a particular job set, in order to confirm that the total dollar amount of all checks corresponds to a predetermined amount. In this particular example, the dollar amount may be referenced to a five digit number, termed a "matrix 2 of 5 code", composed of a series of wide and narrow black bars with intervening wide and narrow white spaces therebetween, wherein a wide bar or wide space may be used to represent a binary "1", while a narrow bar or narrow space may be used to represent a binary "0". In this type of bar code, each character is represented by five bits including three black spaces with the least significant bit on the left (a shown in the drawing) each character is separated by an intercharacter space. One complete bar code 104 consists of a unique stark pattern 141, five message characters 142, a checksum character 143, and a unique stop pattern 144. It will be recognized that various other more sophisticated bar code schemes such as an alphanumeric industry standard identified as "code 39" and "code 128", as well as other information coding techniques which are not necessarily based on bar codes, may be utilized in combination with the present invention.

The bulk of the decoding of the bar code is done in software, minimizing hardware requirements. The prime function of the hardware is to sense the black to white and white to black transitions within the bar code. Sampling of the bar code is preferably accomplished in the approximate center of the bar code along an axis perpendicular to the parallel lines thereof, as represented by reference numeral 145.

It is recognized by the present invention that it may be desirable to place the bar code 104 at various positions on the output copy sheet 101, including any of an infinite number of positions perpendicular to the process direction of the paper path 103 and at positions wherein the orientation of the bar code 104 may be either parallel to the process direction of the paper path 103 or perpendicular to the process direction of the paper path 103. In order to facilitate reading of the bar code 104 independent of its location and orientation on the copy sheet 101, and to assure that the code 104 is not missed or misread, it is necessary to provide a mounting apparatus that allows for selective positioning and orientation of the optical scanner 102 relative to the output copy sheet, and, in particular, with respect the bar code 104 printed thereon. Thus, the present invention is directed toward enabling bar code scanning in an electrostatographic printing machine while permitting the bar code 104 to be printed virtually anywhere on the copy sheet 101 and having an orientation either parallel or perpendicular to the process direction of travel of the copy sheet 101 through the paper path, without affecting the capability of scanning the bar code 104.

Moving now to a detailed description of the scanner mounting apparatus 100 of the present invention, it will be seen from FIGS. 1 and 2 that optical scanner 102 is supported in alignment with copy sheet 101 and, more specifically, in alignment with the information bearing bar code 104, by means of a mounting carriage, generally identified by reference numeral 110. The mounting carriage 110 is formed by a pair of side support members, namely inboard support member 112 and outboard support member 114, having transverse support members 111,113 and 115 fastened thereto for forming a rigid support structure capable of supporting the optical sensor 102. The mounting carriage 110 is fixedly supported along an axis transverse to the paper path for spanning the width of a sheet 101 transported therethrough, travelling along a process direction of travel, indicated by arrow 103.

Mounting carriage 110 includes a slidable baffle member 120, comprising upstream baffle element 121 and downstream baffle element 123 coupled together via handle member 122, located adjacent to outboard support member 114. The slidable baffle member 120 includes a plurality of elongated mounting apertures 126 located in alignment with fixed pins 125 protruding from inboard support member 112 and outboard support member 114, respectively, for slidably securing the baffle member 120 to the mounting carriage 110, whereby the elongated mounting apertures 126 operate in association with fixed pins 125 to permit slidable movement for the baffle member 120 in a direction transverse to the process direction of travel 103 of the copy sheet 101.

Baffle member 120 includes a plurality of spaced sheet guide fingers 124 for applying light pressure against the copy sheet 101 as it passes under the optical scanner 102 so as to substantially constrain upward movement of the copy sheet 101 as it moves in the process direction 103, thereby reducing flutter or other vibratory induced motion of the copy sheet 101 as it is being scanned by the optical scanner 102 for eliminating distortion of the bar code 104 and to prevent misreading thereof. It is noted that the contact surfaces of guide fingers 124 may be advantageously polished or covered with a low surface energy material to reduce friction between the fingers 124 and the copy sheet 101.

Scanner 102 is supported within mounting carriage 110 by means of a rotatable housing 135, attached to a support platform 130, which, in turn, engages with a threaded shaft 133 extending transversely across the width of mounting carriage 110. Threaded shaft 133 is cooperative with a threaded shaft receiver 132 integral to support platform 130, whereby rotation of the threaded shaft 133 is operative to displace the support platform 130 as well as the scanner 102 in a direction indicated by arrows 131, generally transverse to the process direction of travel 103. Support platform 130 is further supported via support stud 134 in association with channel 118, formed in transverse support member 113, whereby the support stud 134/channel 118 combination allows transverse displacement of the support platform 130, as provided by the threaded shaft 133. Rotation of the threaded shaft 133 is facilitated by a rotatable knob 139, preferably located adjacent outboard support member 114 for permitting easy access thereto. In addition, precise positioning of the scanner 102 is facilitated by alignment marker 137 with index markings 117 positioned along the length of transverse support member 111, providing an indication of the scan line of the scanner 102.

The optical scanner 102 is also mounted within a rotatable housing 135 which, in turn, is rotatably mounted on support platform 130. The rotatable housing 135 is rotatable about vertical axis 136, as indicated by arrow 138, for permitting rotation of the scanner 102 to allow the optical scanner 102 to be positioned in proper orientation with respect to the bar code 104. The rotatable housing is preferably provided with detent positions along the circumference of rotation for permitting lockable orientation of the scanner 102. For example, it would be advantageous to provide detents at positions which permit fixed and precise orientation of the scanner either parallel or perpendicular to the process direction of travel 103 for reading codes printed in either the portrait or the landscape print mode or codes which are otherwise either parallel or perpendicular to the process direction of travel 103. It will be understood that the rotatable housing permits rotation of the scanner 102 along a 360 degree path of rotation for accommodating scans of codes which may be placed at the extreme inboard and outboard margins of the copy sheet 101 while meeting the requirement of positioning the scanner at a slight angle relative to the scan line on the copy sheet, as previously discussed Thus, the slidable support platform 130 permits slidable movement of the optical scanner 102 in a direction transverse to the process direction of travel 103 thereof, while rotatable housing 135 permits rotational movement of the optical scanner 102 in a plane parallel to the copy sheet 101. The freedom of movement provided by the combination of the slidable support platform 130 and the rotatable housing 135 cooperate to provide a mounting which permits selective positioning of the scanner 102 for proper alignment with the information bearing bar code 104 independent of its location on the copy sheet 101, while permitting selective orientation of the scanner 102 for proper orientation with the information bearing bar code 104 independent of its orientation on the copy sheet 101.

One particular advantage of the present invention arises from the slidable baffle member 120 which provides continuous read access to the paper path by providing a movable scan opening to eliminate any impediment to allowing codes to be read at any position on the paper. That is, while the present invention clearly provides an advantageous mounting apparatus which enables selective positioning of the optical scanner across the width of the paper path, and which further enables rotation of the optical scanner to permit the scanning of bar codes oriented in both the landscape or portrait orientations, the slidable baffle member 120 allows for continuous stabilization contact with the output copy sheet via fingers 118 in order to stabilize the output copy sheet while it is passing under the optical scanner 102 and yet eliminates any possible interference with the scanning operation as may be created by the fingers 118. As previously discussed, the fingers advantageously operate to substantially constrain the vertical movement of the copy sheet 101, eliminating a possible source of optical scanner bar code misreads. The slidable baffle member 120 is selectively positionable in a direction perpendicular to the process direction of travel of the copy sheet so that any given finger 118 will not overlay the bar code as it passes underneath the scanner, which might prevent the scanning thereof. In this manner, fingers 118 may be selectively positioned so as not to interfere with the optical scanning process while advantageously applying pressure to the copy sheet 101 for stabilization thereof, eliminating a possible cause for bar code misread. Indeed, it will be seen from FIGS. 1 and 2, that the baffle member 120 is provided with a series of indicating bars 127 in alignment with each finger element 118 for aiding the operator in selectively positioning the baffle member 120 to provide a proper scan opening.

In review, the scanner mounting apparatus of the present invention enables selective positioning of the scanner for proper alignment with an information bearing bar code independent of its location on the copy sheet and further enables the selective orientation of the scanner for proper orientation with the information bearing bar code independent of its orientation on the copy sheet. The present scanner mounting apparatus includes a scanner which is mounted to a slidable support platform, for permitting slidable movement of the optical scanner in a direction transverse to the process direction of travel of a copy sheet,the slidable support platform further having a rotatable housing mounted thereto for permitting rotational movement of the optical scanner in a plane parallel to the copy sheet. The freedom of movement provided by the combination of the slidable support platform and the rotatable housing cooperate to provide a mounting which permits selective positioning of the scanner for proper alignment with the information bearing bar code independent of its location on the copy sheet, while permitting selective orientation of the scanner for proper orientation with the information bearing bar code independent of its orientation on the copy sheet.

It is, therefore, evident that there has been provided, in accordance with the present invention, an electrostatographic printing apparatus that fully satisfies the aims and advantages of the present invention as hereinbefore set forth. While this invention has been described in conjunction with a preferred embodiment and method therefor, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for mounting a scanner along a paper path for permitting scanning of an information bearing code from a document traveling in a process direction of travel through the paper path, comprising:

means for selectively positioning the scanner in a direction transverse to the process direction of travel to position the scanner in a fixed position in substantial alignment with the information bearing code on the document traveling through the paper path; and means for selectively rotating the scanner with respect to the document travelling through the paper path to position the scanner in a fixed position in proper orientation for reading the information bearing code on the document traveling through the paper path.

2. The apparatus of claim 1, further including:

a mounting carriage situated transverse to the paper path for spanning the document traveling therethrough;

a support platform for supporting the scanner in the mounting apparatus, said support platform including a threaded shaft receiver integral therewith; and a threaded shaft extending through said mounting apparatus so as to be situated along an axis transverse to the paper path;

said threaded shaft and said threaded shaft receiver being cooperatively engaged such that rotation of the threaded shaft is operative to displace the support platform in a direction transverse to the process direction of travel.

3. The apparatus of claim 2, wherein said threaded shaft includes a rotatable knob for facilitating precise positioning of the scanner.

4. The apparatus of claim 2, wherein:

said mounting carriage includes a plurality of index markings situated along an axis transverse to the paper path for providing a precise indication of a scan line of the scanner.

5. The apparatus of claim 2, further including:

a rotatable housing for receiving the scanner, the rotatable housing being rotatably mounted on said support platform for permitting rotation of the scanner with respect to the document traveling through the paper path to position the scanner in proper orientation for reading the information bearing code on the document traveling through the paper path.

6. The apparatus of claim 5, wherein said rotatable housing further includes a plurality of detent positions situated along a circumference of rotation for permitting fixed and precise lockable orientation of the scanner in a position either parallel or perpendicular to the process direction of travel for enabling reading of codes printed on the document either parallel or perpendicular to the process direction of travel.

7. The apparatus of claim 2, further including a baffle member having a plurality of spaced sheet guide fingers for applying light pressure against the document to substantially constrain upward movement of the document traveling through the paper path.

8. The apparatus of claim 7, wherein said baffle member is slidably secured to said mounting carriage for permitting slidable movement of the baffle member in a direction transverse to the process direction of travel.

9. The apparatus of claim 8, wherein said baffle member includes of index markings situated in alignment with each of said sheet guide fingers for providing assistance in selectively positioning the baffle member to provide a scan opening such that said sheet guide fingers will not interfere with the scanner.

10. The apparatus of claim 7, wherein said sheet guide fingers include a low surface energy coating material for reducing friction between said fingers and the document traveling through the paper path.

11. An electrostatographic printing machine including a scanner for scanning an information bearing code situated on a document, comprising:

an apparatus for mounting the scanner along a paper path, said document traveling in a process direction of travel through the paper path;

means for selectively positioning the scanner in a direction transverse to the process direction of travel to position the scanner in a fixed position in substantial alignment with the information bearing code on the document traveling through the paper path; and means for selectively rotating the scanner with respect to the document travelling through the paper path to position the scanner in a fixed position in proper orientation for reading the information bearing code on the document traveling through the paper path.

12. The electrostatographic printing machine of claim 11, further including:

a mounting carriage situated transverse to the paper path for spanning the document traveling therethrough;

a support platform for supporting the scanner in the mounting apparatus, said support platform including a threaded shaft receiver integral therewith; and a threaded shaft extending through said mounting apparatus so as to be situated along an axis transverse to the paper path;

said threaded shaft and said threaded shaft receiver being cooperatively engaged such that rotation of the threaded shaft is operative to displace the support platform in a direction transverse to the process direction of travel.

13. The electrostatographic printing machine of claim 12, wherein said threaded shaft includes a rotatable knob for facilitating precise positioning of the scanner.

14. The electrostatographic printing machine of claim 12, wherein:

said mounting carriage includes a plurality of index markings situated along an axis transverse to the paper path for providing a precise indication of a scan line of the scanner.

15. The electrostatographic printing machine of claim 12, further including:

a rotatable housing for receiving the scanner, the rotatable housing being rotatably mounted on said support platform for permitting rotation of the scanner with respect to the document traveling through the paper path to position the scanner in proper orientation for reading the information bearing code on the document traveling through the paper path.

16. The electrostatographic printing machine of claim 15, wherein said rotatable housing further includes a plurality of detent positions situated along a circumference of rotation for permitting fixed and precise lockable orientation of the scanner in a position either parallel or perpendicular to the process direction of travel for enabling reading of codes printed on the document either parallel or perpendicular to the process direction of travel.

17. The electrostatographic printing machine of claim 12, further including a baffle member having a plurality of spaced sheet guide fingers for applying light pressure against the document to substantially constrain upward movement of the document traveling through the paper path.

18. The electrostatographic printing machine of claim 17, wherein said baffle member is slidably secured to said mounting carriage for permitting slidable movement of the baffle member in a direction transverse to the process direction of travel.

19. The electrostatographic printing machine of claim 18, wherein said baffle member includes of index markings situated in alignment with each of said sheet guide fingers for providing assistance in selectively positioning the baffle member to provide a scan opening such that said sheet guide fingers will not interfere with the scanner.

20. The electrostatographic printing machine of claim 17, wherein said sheet guide fingers include a low surface energy coating material for reducing friction between said fingers and the document traveling through the paper path.

* * * * *